US005873614A

United States Patent [19]

Taylor et al.

[11] Patent Number: 5,873,614

[45] Date of Patent: Feb. 23, 1999

[54] ANCHOR FOR A CARPET STRETCHING APPARATUS

[75] Inventors: Robert Edward Taylor, Columbia; Paul Wesley Yngve, Chapin, both of S.C.

[73] Assignee: E. I. du Pont de Nemours and Company, Wilmington, Del.

[21] Appl. No.: 879,940

[22] Filed: Jun. 20, 1997

[51] Int. Cl.[6] ..... A47G 27/04; B25B 25/00

[52] U.S. Cl. ..... 294/8.6; 254/200

[58] Field of Search ..... 294/8.6; 254/200, 254/201, 206, 207, 209, 210, 212

[56] References Cited

U.S. PATENT DOCUMENTS

| | | | |
|---|---|---|---|
| 448,992 | 3/1891 | Pool | 254/209 |
| 2,326,117 | 8/1943 | Bartlow | 254/212 |
| 2,606,743 | 8/1952 | Owens | 254/62 |
| 3,706,440 | 12/1972 | Ross | 254/62 |
| 3,747,157 | 7/1973 | Szymanski | 16/5 |
| 3,752,440 | 8/1973 | Ream | 254/62 |
| 3,791,624 | 2/1974 | Payson | 254/62 |
| 3,917,225 | 11/1975 | Payson | 254/60 |
| 3,945,609 | 3/1976 | Platek | 254/60 |
| 3,951,382 | 4/1976 | Asbury | 254/62 |
| 3,952,997 | 4/1976 | Whitlock | 254/200 |
| 3,963,216 | 6/1976 | Victor | 254/62 |
| 3,977,651 | 8/1976 | Chamberlain | 254/57 |
| 3,980,274 | 9/1976 | Ebert | 254/57 |
| 4,003,549 | 1/1977 | Sergerie | 254/62 |
| 4,008,879 | 2/1977 | Youngman | 254/57 |
| 4,042,211 | 8/1977 | Hammond et al. | 254/57 |
| 4,076,213 | 2/1978 | Payson | 254/60 |
| 4,084,787 | 4/1978 | Kowalczyk | 254/201 |
| 4,230,302 | 10/1980 | Crain, Jr. | 254/212 |
| 4,230,303 | 10/1980 | Schilz | 254/212 |
| 4,361,311 | 11/1982 | Koroyasu et al. | 254/200 |
| 4,394,004 | 7/1983 | Allen et al. | 254/204 |
| 4,509,725 | 4/1985 | Taiavera | 254/212 |
| 4,538,846 | 9/1985 | Alexander | 294/8.6 |
| 4,627,653 | 12/1986 | Koroyasu | 294/8.6 |
| 4,730,858 | 3/1988 | Humann | 294/8.6 |
| 4,772,058 | 9/1988 | Andersen | 294/8.6 |
| 4,815,708 | 3/1989 | Samson | 254/212 |
| 4,828,305 | 5/1989 | Gaddy | 294/8.6 |
| 4,934,658 | 6/1990 | Berg et al. | 254/212 |
| 4,949,604 | 8/1990 | Squires | 81/488 |
| 5,007,616 | 4/1991 | Scarpino | 254/212 |
| 5,145,225 | 9/1992 | Muller et al. | 294/8.6 |
| 5,150,884 | 9/1992 | Hyer et al. | 254/209 |
| 5,176,387 | 1/1993 | Taggart | 294/8.6 |
| 5,183,238 | 2/1993 | Sorensen | 254/209 |
| 5,228,660 | 7/1993 | Massicotte | 254/201 |
| 5,255,894 | 10/1993 | Guarneri | 254/200 |
| 5,269,576 | 12/1993 | Krebs et al. | 294/8.6 |
| 5,288,057 | 2/1994 | Listau | 254/212 |
| 5,364,143 | 11/1994 | Grady | 294/8.6 |
| 5,472,170 | 12/1995 | Anasson | 254/212 |
| 5,484,136 | 1/1996 | Lopes et al. | 254/200 |
| 5,681,031 | 10/1997 | Foley | 254/209 |

OTHER PUBLICATIONS

Roberts Power Stretcher brochure (undated) 3 pages.

*Primary Examiner*—Dean Kramer

[57] ABSTRACT

An anchor connectable to a carpet stretching apparatus includes a generally L-shaped member in which a first leg defines a base while a second leg forms an upright backstop. The base has a forward edge and an underside thereon. A plurality of inclined gripping pins engageable with the carpet is disposed on the underside of the base. The gripping pins are inclined from the forward edge toward the backstop. The L-shaped member is engageable with a carpet stretching apparatus so that a force generated by the carpet stretching apparatus while stretching a carpet reacts against the backstop at a point of application substantially rearwardly of the gripping pins in the direction of inclination thereof.

1 Claim, 1 Drawing Sheet

ANCHOR FOR A CARPET STRETCHING APPARATUS

BACKGROUND OF THE INVENTION

1. Field of the Invention

The present invention relates to an anchor in the form of a gripping cleat for anchoring an apparatus for stretching a carpet.

2. Description of the Prior Art

It is the usual practice when laying wall-to-wall carpet (whether over a pad or directly over a floor) to attach a first edge of the carpet to the floor (usually, but not necessarily, adjacent to one wall of the room) and to unroll the carpet toward the opposite wall of the room. The carpet attachment may be effected using adhesive, or, as is perhaps more common, by laying the carpet over the upstanding spikes of a "tack strip" that is itself mounted adjacent to the wall. Before the other edge of the carpet is itself attached, it is necessary to stretch the carpet to eliminate wrinkles or creases in the carpet.

There are a variety of available devices that are used to stretch carpet. In one of the more common devices, a "knee kicker", a force is generated by impacting the knee of the installer against the device. Other devices, so-called "power stretchers", include some form of linkage arrangement that converts a downward force applied to an operating lever into a generally horizontal stretching force imposed on a stretching head. The power stretcher involves the use of the operator's arms to apply the downward force to the lever.

In order for the displacement of a carpet gripping head from the retracted to the extended position to impart a stretching action to the carpet the stretching apparatus must be anchored at a predetermined reference location with respect to the floor. Only when so anchored and braced will a horizontal stretching force be imposed into the carpet to stretch the same with respect to the floor.

In the usual instance an abutment surface that lies behind the stretching apparatus is used to anchor the stretching apparatus in position. The abutment surface in such cases is usually defined either by the baseboard of a distant wall or by a gripping cleat, known as a "dead man", that is secured to the carpet behind the stretching apparatus. Since the abutment surface is usually disposed some distance behind the stretching apparatus it is conventional practice to utilize an extension arrangement to bridge the distance between the stretching apparatus and the abutment surface. A "dead man" is a gripping cleat that is typically fabricated using a plank of stock lumber onto the undersurface of which is attached a plurality of tack strips. The tack strips usually extend in the axial direction of the plank, with the spikes of the tack strip extending into the carpet when the undersurface of the "dead man" is laid on the carpet.

The form of gripping cleat known as the "dead man" has a tendency to roll from its engagement with the carpet. The usual expedient used to prevent this occurrence is to require another person to stand on the "dead man" and physically hold it in place during use. This necessity is seen as economically unattractive.

It is believed advantageous to provide an anchor arrangement in the form of a gripping cleat which eliminates the requirement of any additional expedient to hold it in place in the carpet during use.

SUMMARY OF THE INVENTION

The present invention is directed to an anchor connectable to a carpet stretching apparatus. The anchor comprises a generally L-shaped member in which a first leg defines a base while a second leg forms an upright backstop. The base has a forward edge and an underside thereon. A plurality of gripping heads is disposed on the underside of the base. The gripping heads have a plurality of inclined gripping pins engageable with the carpet. The gripping pins are inclined from the forward edge toward the backstop. The L-shaped member is engageable with a carpet stretching apparatus so that a force generated by the carpet stretching apparatus while stretching a carpet reacts against the backstop at a point of application substantially rearwardly of the gripping pins in the direction of inclination thereof.

BRIEF DESCRIPTION OF THE DRAWING

The invention will be more fully understood from the following detailed description, taken in connection with the accompanying drawings, in which:

FIG. 1 is a perspective view of an anchor arrangement in accordance with various aspects of the present invention, while

DETAILED DESCRIPTION OF THE INVENTION

Figure 1A:
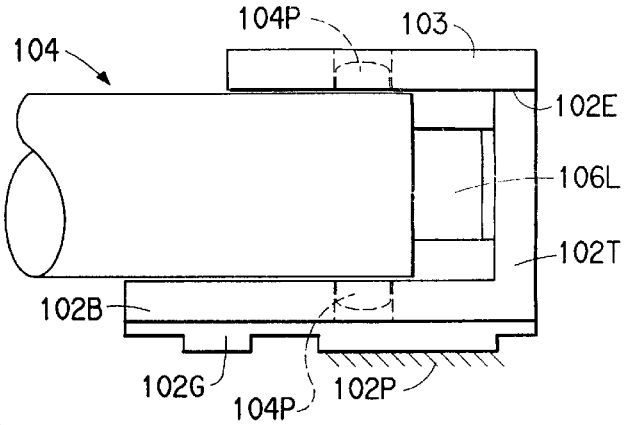
FIG. 1A is a side elevational view of the anchor arrangement of FIG. 1.

Throughout the following detailed description, similar reference numerals refer to similar elements in all Figures of the drawings.

Figure 1:
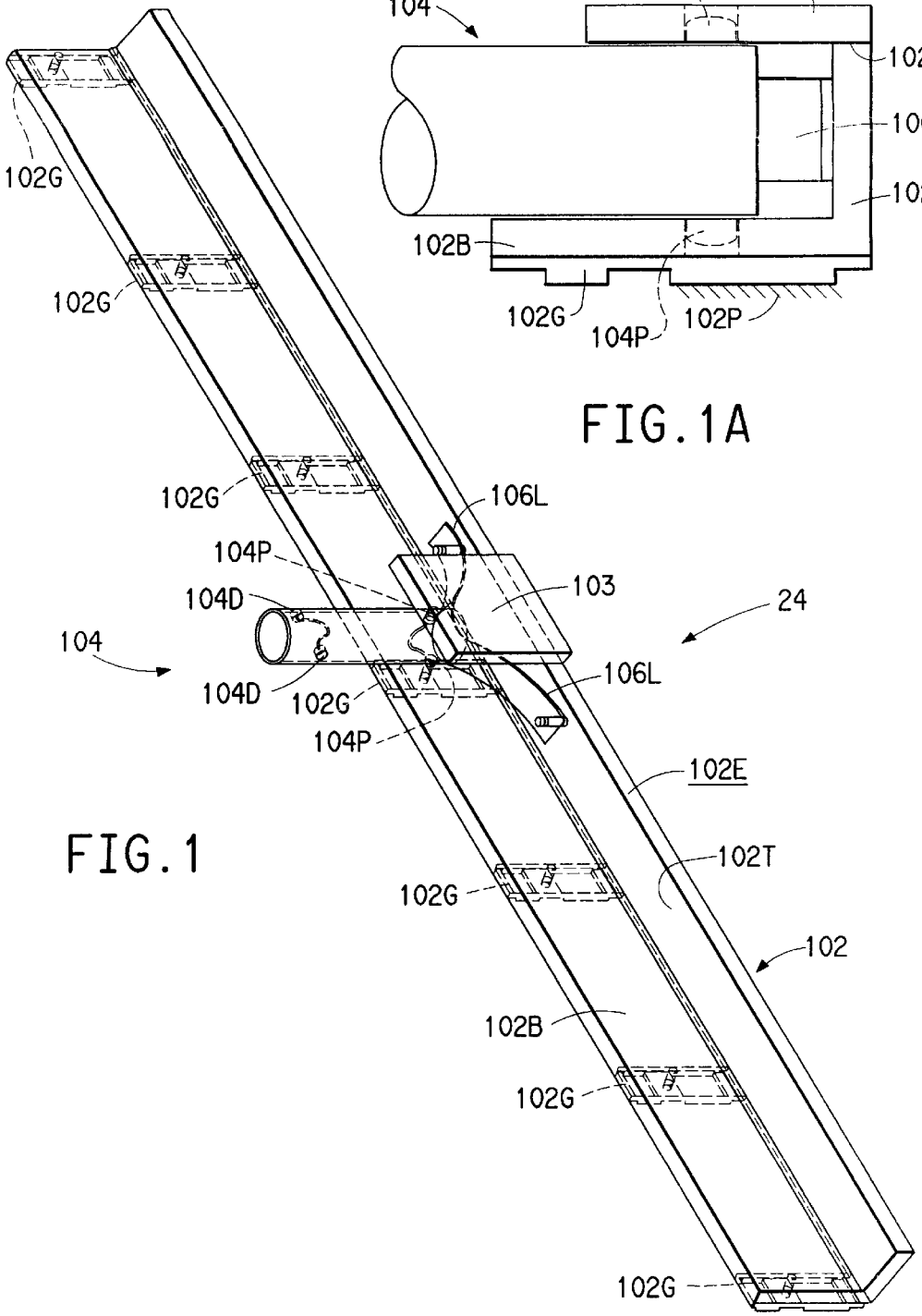

FIG. 1 illustrates a perspective view of an anchor arrangement 24 in accordance with the present invention. The anchor of the present invention takes the form of a gripping cleat that engages a carpet behind a stretching apparatus. The gripping cleat 24 defines a suitable reaction surface against which the stretching apparatus is braced, such that the displacement of the gripping head of the stretching apparatus will impose the stretching force generated thereby into the carpet.

The gripping cleat 24 is a generally L-shaped member 102 in which one leg defines a base 102B while the other leg forms an upright backstop 102T. The underside 102U of the base 102B has a plurality of gripping strips 102G. The gripping strips 102G each have gripping pins 102P that are engageable with the carpet. As is best seen in FIG. 1A, the gripping pins 102P incline with respect to the base 102B in a direction toward the backstop 102T. Suitable for use as the gripping heads is the "Cotton Grip Head" sold by Crain Cutter Company, Milpitas, Cali., model 500-Z or 520-Z.

A cover plate 103 is attached to the upper edge 102E of the upright backstop 102T. A tubular connector 104 is pivotally engaged between the cover plate 103 and the base 102B on a pair of spring loaded pins 104P. A respective one of the pins 104P engages with an opening formed for this purpose in the base 102B while the other one of the pins 104P engages with the opening in the cover 103, respectively. It may be desirable to utilize a single axle pin to connect the cover plate 103, the connector 104 and the base 102B.

The connector 104 also has a pair of spring-loaded detent pins 104D adjacent its forward end. The detent pins 104D in the tubular connector 104 are engageable with opening provided in an adapter, thereby to interconnect the anchor 24 to the stretching apparatus or to a suitable extension arrangement extending therefrom.

The end of the connector 104 is spaced a clearance distance forward of the backstop 102T. A bias arrangement, in the form of a leaf spring 106L, is disposed between the end of the tubular connector 104 and the backstop 102T. The bias arrangement serves to bias the tubular connector 104 into perpendicularity with respect to the inside face 102F of the upright 102T.

As noted earlier, the gripping cleat available in the prior art (the "dead man") had a tendency to roll from its engagement with the carpet, requiring that another operator stand on the "dead man" and hold it in place during use. It has been found that this tendency occurs because force generated by the stretching apparatus is applied to the "dead man" forwardly of the gripping pins.

In accordance with the present invention the tendency to roll is cured by having any forces 108 generated by the displacement of the gripping head of the stretching apparatus imposed into the upright backstop 102T, via the pinned engagement of the connector 104 to the plate 103 and the base 102B. The connector 104 is connected to the L-shaped member 102 in a such way that pivotal motion of the connector 104 with respect to the backstop in a plane perpendicular to the plane of the carpet is prevented from occurring. By imposing forces from the stretching apparatus into the backstop 102T at a point of application substantially rearwardly (in the direction of inclination of the gripping pins 102P) of the pins 102P, the pins 102P are drawn into the carpet C and the tendency of the gripping pins 102P to roll from the carpet is reduced.

Those skilled in the art, having the benefit of the teachings of the present invention as set forth herein, may effect numerous modifications thereto. Such modifications are to be construed as lying within the contemplation of the present invention, as defined by the appended claims.

What is claimed is:

1. An anchor connectable to a carpet stretching apparatus, the anchor comprising a generally L-shaped member in which a first leg defines a base while a second leg forms an upright backstop, the backstop having an upper edge thereon, a cover plate being attached to the backstop at the upper end thereof, the base having a forward edge and an underside thereon, a plurality of inclined gripping pins engageable with the carpet being attached to the underside of the base, the gripping pins being inclined from the forward edge toward the backstop, a tubular connector pivotally attached to the cover plate and to the base by a pin connection, the tubular connector having a forward end thereon, the tubular connector being engageable at its forward end with a carpet stretching apparatus so that a force generated by the carpet stretching apparatus while stretching a carpet is transmitted through the tubular connector through the cover and the base and reacts against the backstop at a point of application substantially rearwardly of the gripping pins in the direction of inclination thereof.

* * * * *